US005944080A

United States Patent [19]

Podwika

[11] Patent Number: 5,944,080

[45] Date of Patent: Aug. 31, 1999

[54] MONEY AND CARD HOLDER

[76] Inventor: Paul P. Podwika, 276 Ellen Ave., State College, Pa. 16803

[21] Appl. No.: 09/081,848

[22] Filed: May 20, 1998

Related U.S. Application Data

[60] Provisional application No. 60/047,415, May 22, 1997.

[51] Int. Cl.[6] ..... A45C 11/18

[52] U.S. Cl. ..... 150/147; 150/137; 206/38; 206/39

[58] Field of Search ..... D11/78.1; D3/215, D3/247; 150/137, 147; 206/37, 39

[56] References Cited

U.S. PATENT DOCUMENTS

| | | | |
|---|---|---|---|
| D. 160,004 | 9/1950 | Moulson . | |
| D. 368,868 | 4/1996 | Velleco . | |
| 773,392 | 10/1904 | Holsapple . | |
| 1,619,644 | 3/1927 | Wetzel | 150/134 X |
| 1,761,809 | 6/1930 | Ancla | 206/37 R |
| 1,766,599 | 6/1930 | Cahill | 150/137 X |
| 1,857,488 | 5/1932 | Weeks | 150/137 X |
| 1,915,213 | 6/1933 | Brenner | 150/147 X |
| 2,448,900 | 9/1948 | Mayo | 206/39 |
| 2,634,778 | 4/1953 | Wax . | |
| 2,904,090 | 9/1959 | Rudberg . | |
| 4,784,199 | 11/1988 | Wise . | |
| 5,115,909 | 5/1992 | Hull et al. | 150/137 X |
| 5,275,217 | 1/1994 | Eakin | 150/147 X |
| 5,358,019 | 10/1994 | Sumner . | |
| 5,520,230 | 5/1996 | Sumner . | |

FOREIGN PATENT DOCUMENTS

| | | |
|---|---|---|
| 0251900 | 1/1988 | European Pat. Off. . |
| 2373988 | 7/1978 | France . |

*Primary Examiner*—Sue A. Weaver
*Attorney, Agent, or Firm*—John J. Elnitski, Jr.

[57] ABSTRACT

A money and card holder have a base with an integral retaining clip and an elastic retaining band. The base is a substantially rectangular in shape with an upper surface and an opposed substantially planar lower surface. Extending perpendicularly upwardly from the upper surface at one end of the base is a vertically-rising portion which joins the retaining clip to the base. The end of the retaining clip nearest the vertically rising portion is generally arched to bias the clip in a direction toward the base. The clip extends from the one end of the base toward the opposite end thereof, terminating with a leading edge that slopes upwardly and away from the upper surface to facilitate grasping by the user. Depending from an inner surface of the retaining clip is an extension, and formed on the upper surface of the base is a corresponding depression which is positioned in opposed registry with the extension and configured to receive the extension. The upper surface of the base also includes a recess which extends transversely between the side edges. The recess is sized and configured to receive a portion of an elastic retaining band which is formed into a continuous loop that encircles the base. The remaining portion of the retaining band is positioned to overlay the lower surface of the base. The one portion of the retaining band can be permanently secured within the recess.

13 Claims, 4 Drawing Sheets

MONEY AND CARD HOLDER

This application claims priority to U.S. Provisional Application Number 60/047,415 filed May 22, 1997.

BACKGROUND OF THE INVENTION

1. Field of the invention

The present invention relates generally to money clips and the like, and more specifically the present invention relates to devices for holding money and cards.

2. Description of related art

It is often desirable for individuals to maintain their paper money and cards (i.e., credit cards, debit cards, identification cards, and the like) in a convenient location other than a wallet. Wallets are usually placed in a rear pocket of pants and are visually apparent. Therefore, wallets are susceptible to lifting by a pickpocket. As an alternative, many individuals prefer to carry their paper money and cards in a front pocket in order to hide the money and cards. The front pocket is a location that makes lifting of its contents a less likely event. However, with a large volume of paper money and several cards, the contents of a pocket may become quite disorganized. Thus, there is a need for a device which organizes the money and cards, yet allows easy access of both by the user.

The related art has recognized this need and includes a variety of a money and card holding devices. U.S. Pat. No. Des. 160,004 issued to Moulson on Sep. 5, 1950 discloses an ornamental design for a backing portion of a money clip.

U.S. Pat. No. Des. 368,868 issued to Velleco on Apr. 16, 1996 discloses an ornamental design for a money and card holder that includes a pair of resilient bands, namely an inner band and an outer band which are joined together at one end thereof. The inner band may be used to retain cards, and upon folding of paper money about the cards the outer band may be used to retain the money.

U.S. Pat. No. 773,932 issued to Holsapple on Oct. 25, 1904 discloses a pocket book for bills or bank notes. The pocket book includes a front and rear cover which are hingedly connected together, and an elastic band secured to one cover for retaining the free ends of the two covers together in a closed position.

U.S. Pat. No. 2,634,778 issued to Wax on Apr. 14, 1953 discloses a card case formed of a T-shaped blank of material which is foldable to provide a case that may be secured in a closed formation by fasteners to retain cards or keys therein.

U.S. Pat. No. 2,904,090 issued to Rudberg on Sep. 15, 1959 discloses a T-shaped blank of material which is foldable to provide a purse that is secured in a closed formation by a resilient band that encircles the case. A rigid money clip is secured to the outside of the band for stiffening of the purse.

U.S. Pat. No. 4,784,199 issued to Wise on Nov. 15, 1988 discloses a wallet with a removable clip that permits the wallet to be clipped onto a wearer's waistband. The clip includes three legs such that a first leg is inserted into the wallet and a second leg is biased toward the first leg to retain the wallet to the clip, and a third leg is biased toward the second leg to retain the clip against the waistband.

U.S. Pat. Nos. 5,358,019 and 5,520,230 issued to Sumner, III on Oct. 25, 1994 and May 28, 1996, respectively, disclose a pocket card holder with money clip. The device includes a thin, flat member with a pair of retaining member depending from one side of the flat member and a spring clip formed on the other side thereof. The retaining members, regardless of their orientation, are spaced apart in an opposed confronting relationship to accommodate cards of uniform shape, and the spring clip may retain paper money.

French Patent No. 2,373,988 to Riehm, published on Jul. 13, 1978, discloses the use of mating hook and loop fasteners, one of which is secured to an object and the other of which is secured to the interior of a pocket or handbag. The mating fasteners may be used to retain the object within the pocket or handbag.

European Patent Application Publication No. 0,251,900 (Al) to Vidal, published on Jan. 7, 1988, discloses a card holder in the form of a base, a transparent cover, and two lateral sides joined to the base. The sides internal faces have an elastic part that exerts slight pressure on a card inserted therein. The cover and base have ribs parallel to the lateral sides that prevent deformation of the card.

None of the above inventions and patents, taken either singly or in combination, is seen to describe the instant invention as claimed.

SUMMARY OF THE INVENTION

Accordingly, it is a principal object of the invention to provide a holder for cards and paper money which is simple and convenient to use.

It is another object of the invention to provide a holder for cards and paper money which is compact when filled with varying amounts of cards and money.

It is a further object of the invention to provide a holder for cards which can retain a plurality of cards equally as well as it can retain a single card.

Yet another object of the invention is to provide a card and money holder which has no sharp edges that may snag and tear clothing.

In accordance with the above-described objectives of the present invention, a money and card holder is provided which includes a base with an integral retaining clip and an elastic retaining band. The base is a generally longitudinally extending member which includes an upper surface and an opposed substantially planar lower surface. The base is substantially rectangular in shape, having blunt comers where its parallel opposed side and end edges join. Extending perpendicularly upwardly from the upper surface at one end of the base is a vertically-rising portion which joins the retaining clip to the base. The end of the retaining clip nearest the vertically rising portion is generally arched to bias the clip in a downward direction (i.e., toward the upper surface of the base). The clip extends from the one end of the base toward the opposite end thereof, terminating with a leading edge that slopes upwardly and away from the upper surface to facilitate grasping by the user. Depending from an inner surface of the retaining clip is an extension and formed on the upper surface of the base is a corresponding depression. The depression is positioned in opposed registry with the extension and configured to receive the same.

The upper surface of the base also includes a recess which extends transversely between the side edges and preferably is located adjacent to the end opposite the one end connected to the retaining clip. The recess is sized and configured to receive a portion of an elastic retaining band which is formed into a continuous loop that encircles the base. The one portion of the retaining band is removably secured within the recess such that the remaining portion of the retaining band is positioned to overlay the lower surface of the base.

Therefore, it also is an object of the invention to provide improved elements and arrangements thereof in an apparatus for the purposes described which is inexpensive, dependable and fully effective in accomplishing its intended purposes. A user may secure a wad of paper money between the retaining clip and one surface of the base, and one or more cards between the retaining band and the opposite surface of the base.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
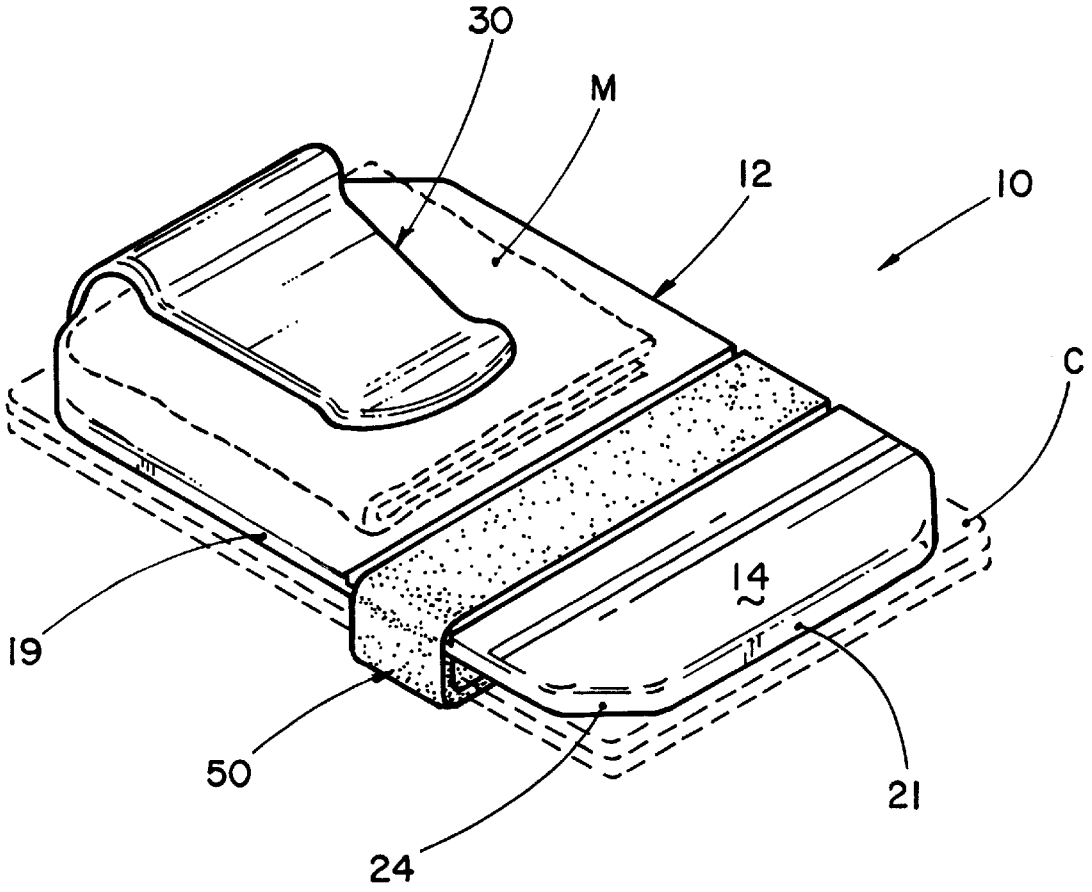
FIG. 1 is a perspective view of a money and card holder according to one embodiment of the present invention, with a plurality of cards and a plurality of bills shown in phantom lines.

Referring now to the figures by numerals of reference and first to FIG. 1, a money and card holder 10 according to one embodiment of the present invention is shown in use holding paper money M and a plurality of cards C. The holder 10 generally includes a base 12 with an integral retaining member (hereinafter referred to as a clip 30) and an elastic retaining band 50. The base 12 and clip 30 are integrally formed, and preferably from any sturdy and lightweight material. Thermoplastic materials are suitable for this purpose due to their strength, weight, and cost. Moreover, the thermoplastic material are preferred over metallic material because the thermoplastic material is incapable of becoming magnetized and therefore will not threaten functionality of any credit cards retained by the holder 10. Any non-magnetic material can be substituted for thermoplastic.

Figure 2:
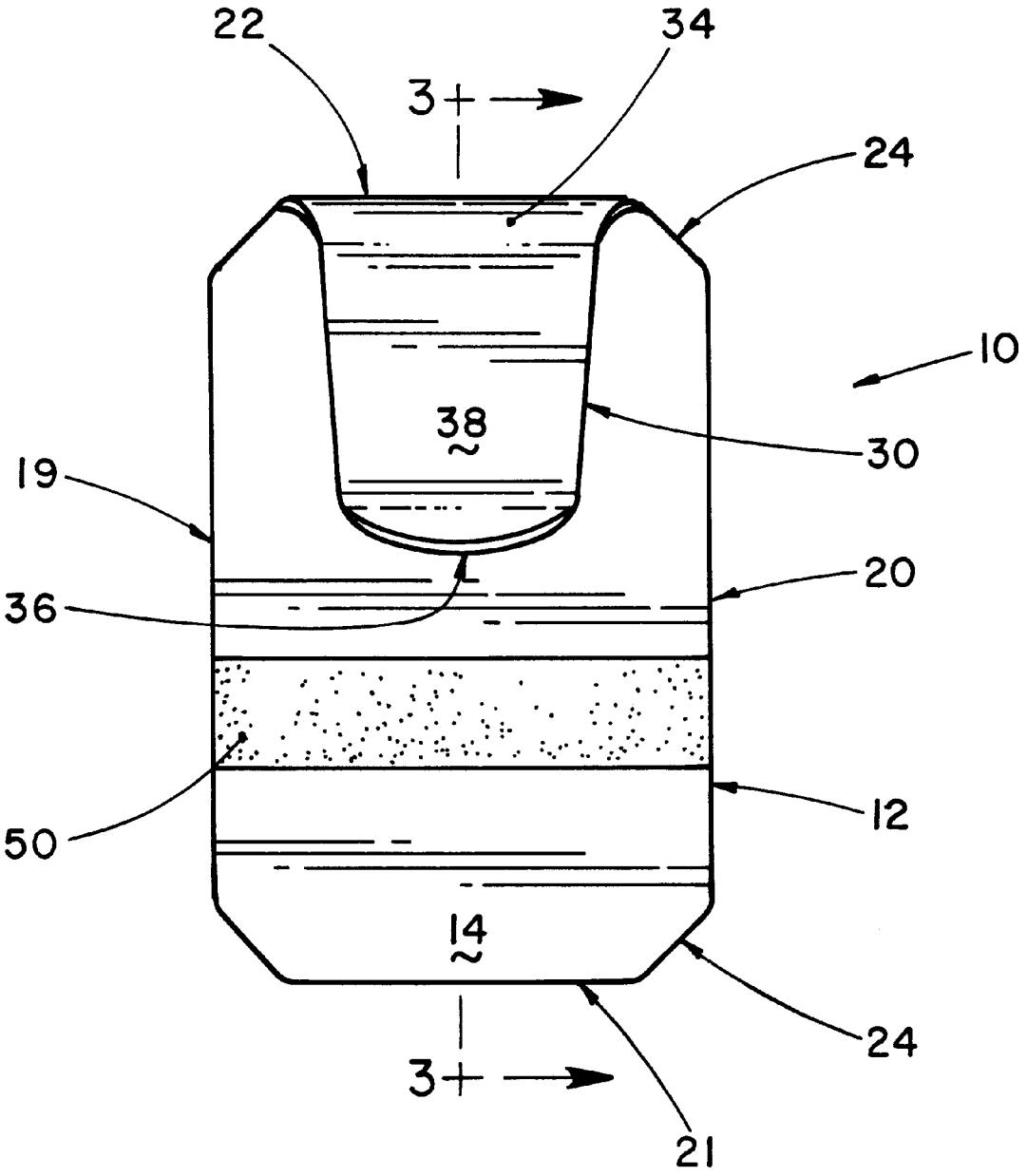
FIG. 2 is a top plan view of the money and card holder according to the embodiment shown in FIG. 1.
Figure 3:
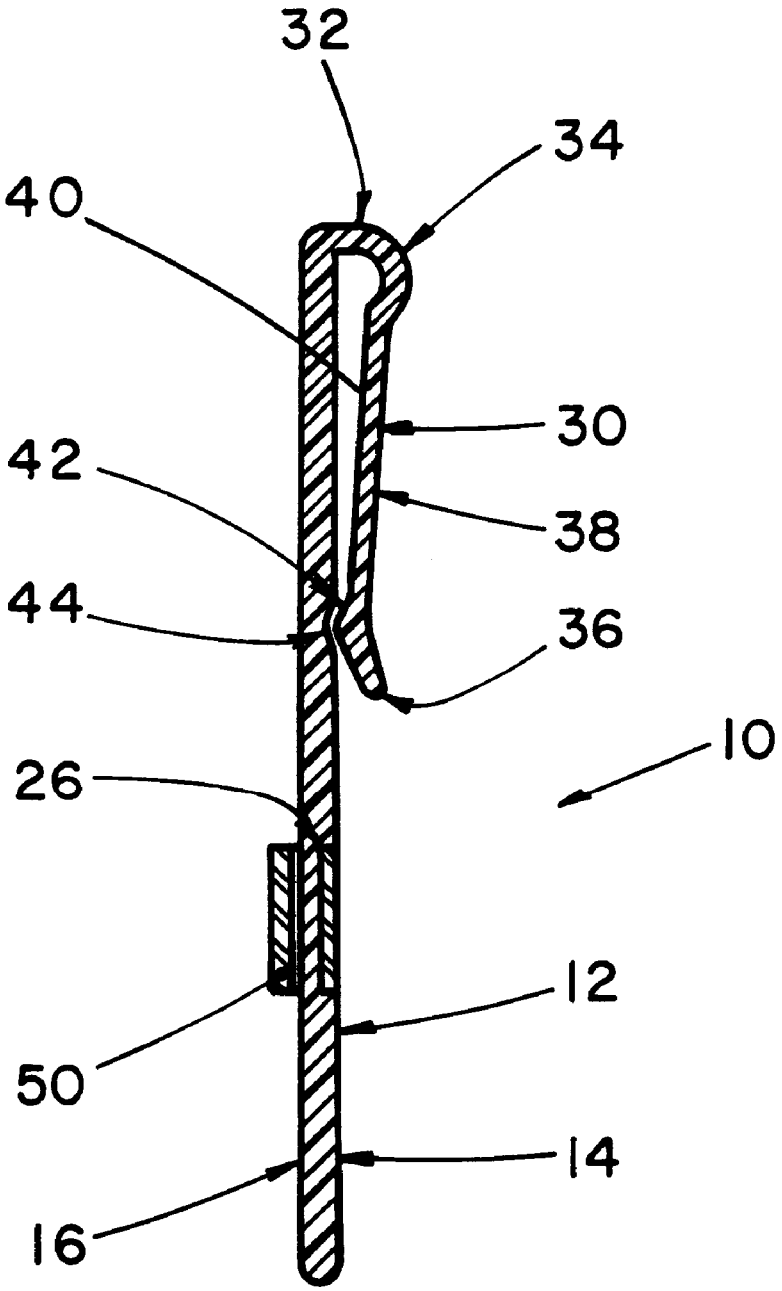
FIG. 3 is a cross sectional view taken along line 3—3 and looking in the direction of the arrows as shown in FIG. 2.

Referring now to FIGS. 2 and 3, the base 12 is a generally longitudinally extending member which includes an upper surface 14 and an opposed substantially planar lower surface 16. The base 12 also includes two opposed longitudinally extending side edges 19, 20 and two transversely extending end edges 21, 22 which extend between respective ends of the side edges 19, 20. Specifically, at each junction between the side edges 19, 20 and the end edges 21, 22 is a blunt corner 24. As shown in FIG. 1, any card C retained by the holder 10 will extend beyond the corners 24 of the base 12. Preferably, however, the comers 24 are rounded (not shown), thus having the base 12 sized virtually identical to a conventional credit card.

Extending perpendicularly upwardly from the upper surface 14 at end 22 of base 12 is a vertically-rising portion 32. The opposite end of the vertically-rising portion 32 is an end 34 of the clip 30; the end 34 of the clip 30 is generally arched to bias the clip 30 in a downward direction (i.e., toward the upper surface 14). The clip 30 extends from the end 22 toward the end 21, terminating with a leading edge 36 that slopes upwardly and away from the upper surface 14.

The clip 30 further includes an outer surface 38 and an opposite inner surface 40. The inner surface 40 faces the upper surface 14 of the base 12. Depending from the inner surface 40 of the clip 30 is an extension 42, which may be formed during a molding operation or upon shaping the clip 30. The extension 42 may be in the form of a pimple, or alternatively the extension 42 may be in the form of a transverse ridge which extends across the inner surface 40 of the clip 30.

The upper surface 14 of the base 12 includes a depression 44 formed therein. The depression 44 is positioned in opposed registry with the extension 42 of the clip 30 and configured to receive the extension 42. Thus, if the extension 42 is formed in the shape of a pimple, the depression 44 is formed as a dimple adapted to receive the is pimple. Likewise, if the extension 42 is formed in the shape of a transverse ridge, then the depression 44 is formed as a transverse groove adapted to receive the ridge.

The upper surface 14 of the base 12 also includes a recess 26 formed therein. The recess 26 extends transversely between the longitudinally extending side edges 19, 20 and the recess 26 is preferably located adjacent to the end 21. The recess 26 is sized and configured to receive a portion of an elastic retaining band 50. The elastic retaining band 50 is formed into a continuous loop that encircles the base 12. The elastic retaining band 50 may be formed of a variety of known materials, such as rubber. Regardless of the material used, the retaining band 50 may be formed into a continuous loop by sealing its ends together or stitching its ends together. Normally a small seam will be formed. The portion of the retaining band 50 engaging the recess 26 can be permanently secured within the recess 26. The remaining portion of the retaining band 50 not engaged with the recess 26 is positioned to overlay the lower surface 16 of the base 12. If the seam is bulky due to overlapping of the band ends, then a through hole (not shown) may be provided within the recess of the base to receive the seam of the retaining band 50. Such a through hole will allow the entire portion of the retaining band 50 to be received within confines of the recess 26.

Figure 4:
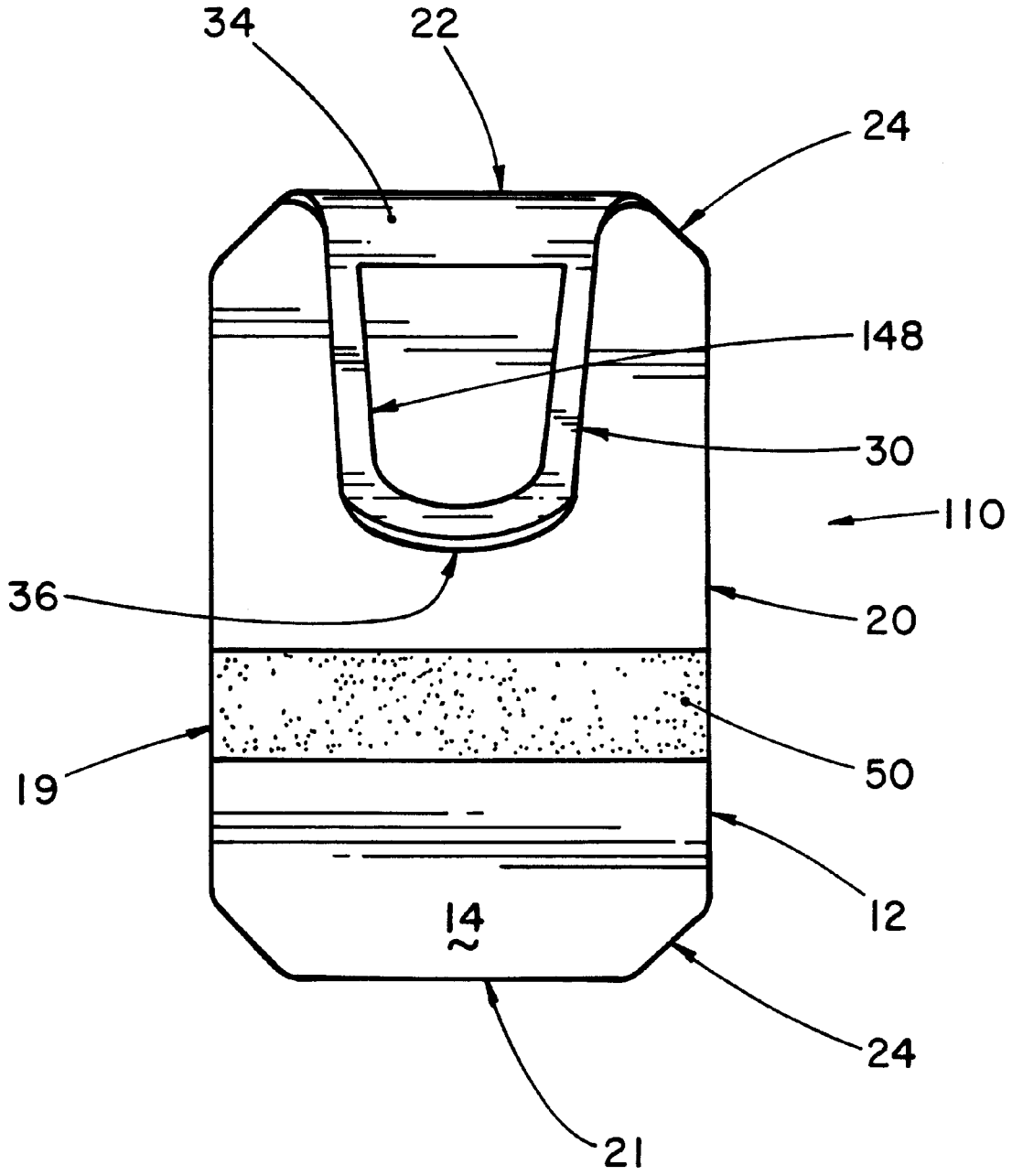
FIG. 4 is a top plan view of a second embodiment of the present invention.

Referring now to FIG. 4, a money and card holder 110 according to a second embodiment of the present invention is shown. As in the first embodiment of the holder 10, the holder 1 10 generally comprises the base 12 with the clip 30 and the elastic retaining band 150. A difference exists in the structure of the clip 30. As before, a vertically-rising portion 32 (not shown) extends perpendicularly upwardly from the upper surface 14 at end 22 of base 12. The opposite end of the vertically-rising portion is an end 34 of the clip 30; the end 34 of the clip 30 is generally arched to bias the clip 30 in a downward direction (i.e., toward the upper surface 14). The clip 30 extends from the end 22 toward the end 21, terminating with the leading edge 36 that slopes upwardly and away from the upper surface 14. The retaining clip 30 further includes an aperture 148 formed therethrough, which minimizes the material requirements of the clip 30 without sacrificing its resiliency and function. The retaining clip 30 also contains the extension 44 (not shown) adapted to be received within a corresponding depression 44 (not shown) of the base 12.

In use, an individual may collect a wad of folded paper money M and insert the money M beneath the retaining clip 30 of either holder 10 or 110. The arched end 34 of the clip 30 biases the clip 30 toward the upper surface 14 of the base 12. The extension 42 thereon guarantees tight contact between the clip 30 and the paper money M, even when the wad of money M is small. This will prevent undesired release of the money M from either holder 10 or 110. To facilitate insertion and removal of the paper money M from beneath the clip 30, the upwardly extending leading edge 36 allows a user to slide one or more bills of money M beneath retaining clip 30. Because the retaining band 50 lies entirely within the recess 26, the retaining band 50 will not interfere with insertion or removal of paper money M. To retain various types of cards C with either holder 10 or 110, a user only needs to expand the retaining band 50 (i.e., with his or her finger) and insert one of the cards C between the band 50 and the lower surface 16 of the base 12. Upon releasing the retaining band 50, such the inserted card will be retained by either holder 10 or 110. Because the base 12 is substantially the same size as most cards C, the base 12 adequately protects the cards C against damage. If multiple cards C are retained by the retaining band 50, a user may identify one or more cards C desired to removed by examining the portion of the cards C that remains visible. To remove such cards C, the user needs only to grasp the desired card or cards C and pull the same in the longitudinal direction. Movement of other cards C may be prevented by placement of the user's hand or fingers in such a manner as to obstruct the movement of such other cards C.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A money and card holder for retaining paper currency and rigid cards, the money and card holder comprising:

a longitudinally extending base having a first surface for supporting money and an opposed substantially planar second surface for supporting cards, two opposed longitudinally extending side edges and two transversely extending end edges, said two end edges extending between respective ends of said longitudinally extending side edges;

a recess formed therein said first surface, said recess extending transversely between said longitudinally extending side edges;

a resilient retaining member integrally formed with said base, said resilient retaining member extending from one of said two transversely extending end edges over said first surface, said resilient retaining member being biased toward said first surface; and an elastic retaining band formed into a continuous loop, said elastic retaining band encircling said base and a portion of said elastic retaining band being within said recess.

2. The money and card holder according to claim 1, wherein said resilient retaining member includes a leading edge which is sloped away from said first surface.

3. The money and card holder according to claim 1, wherein said resilient retaining member includes an outer surface and an inner surface, wherein said inner surface confronts said first surface of said base, and wherein said resilient retaining member includes an extension depending from said inner surface thereof.

4. The money and card holder according to claim 3, wherein said first surface of said base includes a depression formed therein, said depression being positioned and configured to receive said extension of said resilient retaining member.

5. The money and card holder according to claim 1, wherein said recess is formed in said first surface adjacent said transversely extending end edge opposite said end from which said resilient retaining member extends.

6. The money and card holder according to claim 1, wherein said base is of a non-magnetic material to prevent harm to magnetic encoded cards.

7. A money and card holder for retaining paper currency and rigid cards, the money and card holder comprising:

a longitudinally extending base having a first surface for supporting money and an opposed substantially planar second surface for supporting cards, two opposed longitudinally extending side edges and two transversely extending end edges, said two end edges extending between respective ends of said longitudinally extending side edges;

a resilient retaining member integrally formed with said base, said resilient retaining member extending from one of said two transversely extending end edges over said first surface, said resilient retaining member being biased toward said first surface; and an elastic retaining band formed into a continuous loop, said elastic retaining band encircling said base.

8. The money and card holder according to claim 7, wherein said resilient retaining member includes a leading edge which is sloped away from said first surface.

9. The money and card holder according to claim 7, wherein said resilient retaining member includes an outer surface and an inner surface, wherein said inner surface confronts said first surface of said base, and wherein said resilient retaining member includes an extension depending from said inner surface thereof.

10. The money and card holder according to claim 9, wherein said first surface of said base includes a depression formed therein, said depression being positioned and configured to receive said extension of said resilient retaining member.

11. The money and card holder according to claim 7, wherein a portion of said elastic retaining band attached to said first surface.

12. The money and card holder according to claim 7, elastic retaining band is adjacent said transversely extending end edge opposite said end from which said resilient retaining member extends.

13. The money and card holder according to claim 7, wherein said base is of a non-magnetic material to prevent harm to magnetic encoded cards.

* * * * *